US006105233A

United States Patent [19]

Neal

[11] Patent Number: 6,105,233

[45] Date of Patent: Aug. 22, 2000

[54] SHELF FOR A REFRIGERATOR AND METHOD OF MAKING

[76] Inventor: Albert D. Neal, 2400 Florimond Ave., Long Beach, Ind. 46360

[21] Appl. No.: 09/182,835

[22] Filed: Oct. 29, 1998

Related U.S. Application Data

[60] Provisional application No. 60/063,731, Oct. 29, 1997.

[51] Int. Cl.[7] ..... B23P 11/02; A47B 96/04

[52] U.S. Cl. ..... 29/451; 29/460; 29/527.2; 312/408

[58] Field of Search ..... 312/408; 29/451, 29/453, 460, 527.1, 527.2; 211/153; 248/235

[56] References Cited

U.S. PATENT DOCUMENTS

| | | | |
|---|---|---|---|
| 4,923,260 | 5/1990 | Poulsen | 312/214 |
| 5,108,554 | 4/1992 | Deters | 205/145 |
| 5,403,083 | 4/1995 | Dasher et al. | 312/408 |
| 5,403,084 | 4/1995 | Kane et al. | 312/408 |
| 5,439,433 | 8/1995 | Bird et al. | 312/408 |
| 5,486,046 | 1/1996 | Jernstrom et al. | 312/408 |
| 5,516,204 | 5/1996 | Calvert et al. | 312/408 |
| 5,536,081 | 7/1996 | Pokhis | 312/321.5 |
| 5,540,493 | 7/1996 | Kane et al. | 312/408 |
| 5,549,379 | 8/1996 | Jun et al. | 312/408 |
| 5,553,936 | 9/1996 | Dasher et al. | 312/408 |
| 5,584,405 | 12/1996 | Tunzi | 211/153 |
| 5,677,030 | 10/1997 | Shanok et al. | 428/122 |
| 5,735,589 | 4/1998 | Herrmann et al. | 312/408 |
| 5,813,741 | 9/1998 | Fish et al. | 312/408 |
| 5,947,574 | 9/1999 | Avendano | 312/408 |

*Primary Examiner*—David P. Bryant
*Attorney, Agent, or Firm*—Brinks Hofer Gilson & Lione

[57] ABSTRACT

A shelf assembly for a refrigerator or freezer that is fabricated from a plurality of sheet metal stampings that are connected by welds and receive a tempered glass shelf that has an elastic seal secured to its peripheral edge. Welding processes are used in fabricating the frame that produce a very strong weld and eliminate the possibility of rust forming along the weld. The welding processes used in fabricating the frame produce a weld, that when machined and painted is not visible to the naked eye. A zinc..; chromate coating is applied to the frame assembly after which it is painted using a solid-emulsion or powder coating. The finished product thus appears to be formed from a single sheet of material. The seal includes a vertical wall that rises from the glass shelf to creates a reservoir that will contain a spill and confine the spilled liquid to the shelf surface. The seal can be formed by an extrusion process, molded as a separate component or molded to the edge of the glass shelf. The shelf storage system can be mounted at any vertical location in the compartment by mating the mounting hooks of the shelf to appropriate slots in the ladder brackets.

39 Claims, 7 Drawing Sheets

SHELF FOR A REFRIGERATOR AND METHOD OF MAKING

This application claims benefit of Provisional application Ser. No. 60/063,731 filed Oct. 29, 1997.

BACKGROUND OF THE INVENTION

This invention relates to a shelf assembly and, more particularly, to an improved shelf assembly for refrigerators that includes a unique spill resistant shelf design and is economical to manufacture. Typical household refrigerators/freezers include compartments, each of which include a plurality of shelves. The shelves may be mounted such that they are stationary or adjustable relative to the refrigerator cabinet, as is well known. The most common adjustment of the shelves relates to the vertical position of the shelf within the compartment. The vertical adjustment of the shelves allows the shelves to be located to better accommodate food product containers of the height used in the specific refrigerator. Thus, a refrigerator user that stores only short food product containers may be able to have more shelves in a particular refrigerator than a user that stores tall food product containers.

Cantilevered mounted refrigerator shelves, that is a shelf that is supported by support arms or beams which are mounted in a cantilever fashion from slotted brackets attached to the rear wall of the refrigerator cabinet, are currently popular. Cantilevered mounted refrigerator shelves can be dimensioned such that their side and rear edges are spaced from the walls of the compartment a distance sufficient to permit air circulation or convection through the compartment. This is a very desirable feature since it facilitates homogenous temperature distribution and avoids thermal stratification in which a range of temperature zones develop in the compartment.

Food product containers holding liquid are occasionally spilled in a refrigerator. When a spill occurs, other items stored in the refrigerator can become soaked and contaminated. Also, the spilled liquid often flows downward from one shelf to another shelf. For these reasons, it is desirable to contain a spill to a limited area that is on the shelf upon which the spill occurs. This will minimize food spoilage and simplify cleanup. Refrigerator shelves are available that are intended to contain spilled liquid to the shelf where it is spilled and, thus, minimize, if not preclude, downward flow of the spill. However, such shelves often do not have the capacity to contain all of the fluid that spills and in time the seals on these shelves develop leaks.

Available spill resistant shelves include a shelf comprised of multiple-molded components, including shelf sections having a molded perimeter rim member and a pair of support brackets. Each component has an internal metal support. However, when assembled, the internal metal supports are not physically interconnected and, thus, the stability of the shelf is dependent upon the flexibility of the mold material. The mold material contributes little to the utility of the shelf and consumes a relatively large volume within the interior of the refrigerator. The process of setting up for each molded component and the molding process itself are time consuming. As a result, this shelf has a high manufacturing cost.

A shelf component having uncluttered, simple, clean lines has the aesthetic appeal of an efficient, versatile and useful product. Available shelf assemblies require a final assembly of the component parts. This final assembly is a time consuming task that requires skilled labor. If the final assembly is done by the consumer, it is often done improperly and the component parts are vulnerable to becoming lost. Also, food can become trapped in cracks and crevices between adjacent, assembled parts which can result in sanitation and cleaning problems. There is clearly a need for a spill resistant shelf that has the above desirable attributes, clean lines, ease of cleaning and modular adaptability to various storage tasks and which is fully assembled in the manufacturing process.

The present invention provides an improved shelf assembly that overcomes one or more of the problems set forth above.

SUMMARY OF THE INVENTION

In accordance with the present invention, a spill resistant shelf storage system is provided which permits adjustment of the location of the shelf storage system.

There is disclosed herein an adjustable spill resistant shelf storage system that is intended for use in the cabinet of a refrigerator or freezer having a compartment with a rear wall and connecting opposite side walls. The shelf storage system includes a unitary frame mounted in said compartment that extends laterally across the rear wall. The unitary frame includes rearwardly extending hooks that mate with slots formed in the shelf ladder brackets. The shelf storage system can be mounted at any vertical location in the compartment by mating the hooks to appropriate slots in the ladder brackets.

In accordance with the invention, a unitary shelf storage system includes a frame formed from sheet metal stampings that have been welded together along abutting aligned edges to define a unitary framework having vertical sides that function as cantilever beams. A zinc-chromate coating is applied to the unitary framework after which it is painted using a solid emulsion or powder coating. The unitary shelf storage system also includes a flat horizontal portion that functions as the horizontal shelf. The vertical sides include integral hooks that engage slots formed in ladder brackets of the type that are normally used to retain cantilevered shelves in refrigerator compartments.

Accordingly, the present invention provides an economical shelf assembly that features a spill proof shelf including a frame assembly fabricated from sheet metal stampings and a tempered glass shelf having a seal along its periphery that is received by the frame assembly. The frame assembly is a weldment formed from sheet metal stampings and the seal is formed either from extruded seal material or is molded to the tempered glass shelf. Welding processes are used in fabricating the frame that produce a very strong weld and eliminate the possibility of rust forming along the weld. The welding processes used in fabricating the frame produce a weld that, when machined and painted, is not visible to the naked eye. The finished product thus appears to be formed from a single sheet of material. When using an extrusion process for producing the seal material, features of the seal, such as its dimensions and hardness, can be controlled to very close tolerances. As a result, a more effective and durable seal is provided than is available in the prior art. When using a molding process to produce the seal, a one-piece seal that is bonded to the tempered glass shelf and has attractive rounded corners is provided. The seal members receive the peripheral edges of the tempered glass shelf and form a leak-proof seal therebetween. The tempered glass shelf, with the seal attached along its peripheral edges, is seated in a shelf formed in the frame assembly.

There is provided a spill-proof shelf assembly having clean lines and aesthetic appeal that is cantilever mounted on ladder tracks secured to the rear wall of a refrigerator compartment. The shelf assembly includes a pair of cantilevered bracket shelf supports, each of which has a set of hooks for mounting at selected vertical positions within the compartment. Each cantilevered bracket includes a generally vertically oriented wall extending forward of its base portion.

The assembly also includes a rectilinear imperforate shelf member which, in the preferred embodiment, is formed from tempered glass that has spaced apart front, rear and side edges. A seal structure encapsulates the shelf edges. Preferably, the upper surface of the shelf member is planar and has a peripheral edge. The seal structure includes a groove that receives the peripheral edges of the shelf to prevent the flow of liquid between them. The seal structure projects above the upper shelf surface to contain a spill and prevent liquid from running over the side of the shelf member. The height of the seal structure and the area of the shelf are such that at least twelve ounces of fluid can be maintained on the shelf before overflow occurs. Since the most common size of consumer liquid container is twelve ounces, the shelf will have the capacity to confine most spills to the shelf where it occurred.

In a preferred aspect of the invention, the shelf formed in the frame assembly includes a vertical wall portion that is inclined slightly to form an undercut portion into which the seal can expand and, thereby, lock the shelf to the frame assembly.

These and other features, objects, and benefits of the invention will be recognized by those who practice the invention and by those skilled in the art, from the specification, the claims, and the drawings.

DETAILED DESCRIPTION OF THE INVENTION

Figure 3:
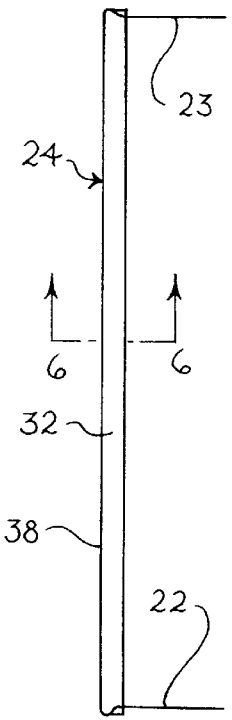
FIG. 3 is a front view of the frame.
Figure 1:
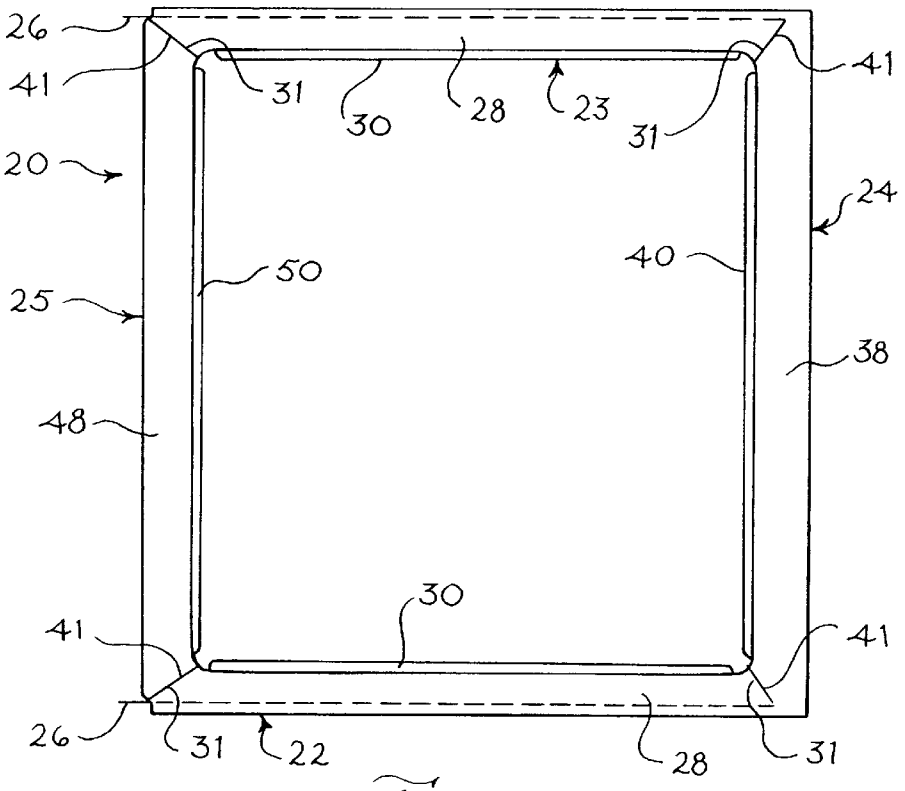
FIG. 1 is a plan view of a sub assembly, comprising the frame, of the refrigerator shelf.

Referring now to FIGS. 1 through 7, the frame 20 of the refrigerator shelf 10 will be discussed. The frame is fabricated from four sheet metal stampings, left 22 and right 23 brackets and front 24 and back 25 sections, that are welded together. Although the dies required for producing sheet metal stampings have a relatively high initial cost, if a large volume of product is produced on the dies, the per unit cost price becomes very economical. The subject invention, refrigerator shelves, is the type of product that, when manufactured on a commercial scale, will be produced in large quantities. As a result, the unit cost of the sheet metal stampings will be quite low. Sheet metal stampings have the further advantage that the resulting products can be held to very close tolerances without the need for time consuming molding operations. As a result, precision sheet metal stampings can be produced very economically. Of course, components fabricated as sheet metal stampings must have relatively simple designs and cannot, for example, include undercuts. However, by producing the frame 20 from four separate sheet metal stampings that are joined by welding, the finished product can have a complex design including undercuts. Left 22 and right 23 frame brackets are joined at their ends by welding to the ends of front 24 and rear 25 frame sections.

Figure 2:
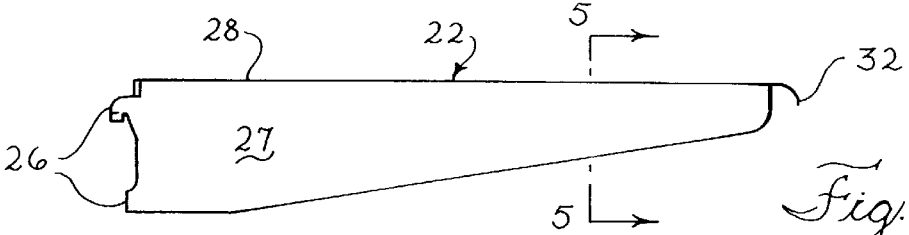
FIG. 2 is a side view of the sub assembly seen in FIG. 1.
Figure 4:
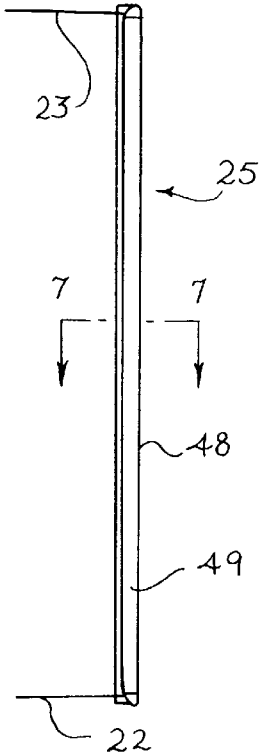
FIG. 4 is a back view of the frame.
Figure 5:
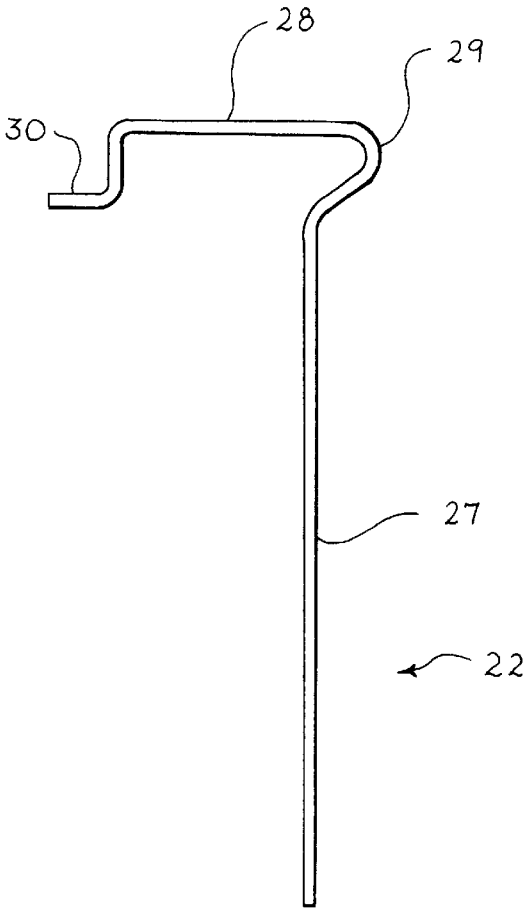
FIG. 5 is a cross section view of the side of the frame taken along lines 5—5 of FIG. 2.
Figure 5A:
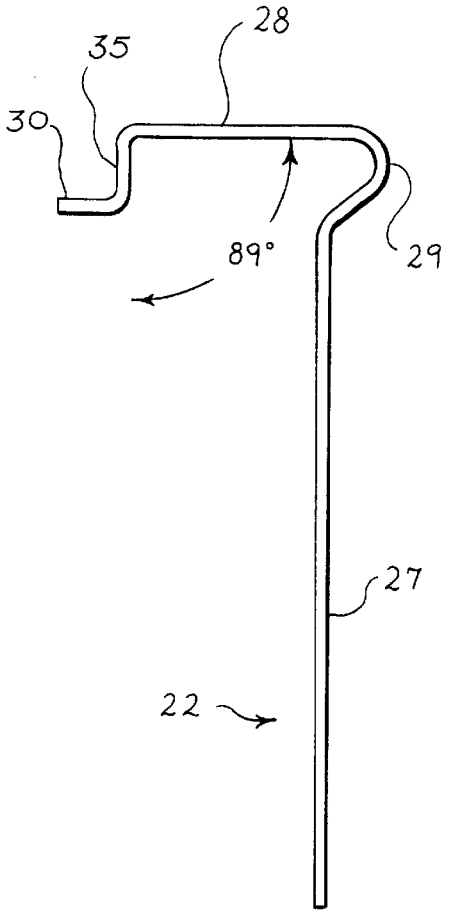
FIG. 5A is a cross section view, similar to FIG. 5, of another embodiment of the frame side.
Figure 10:
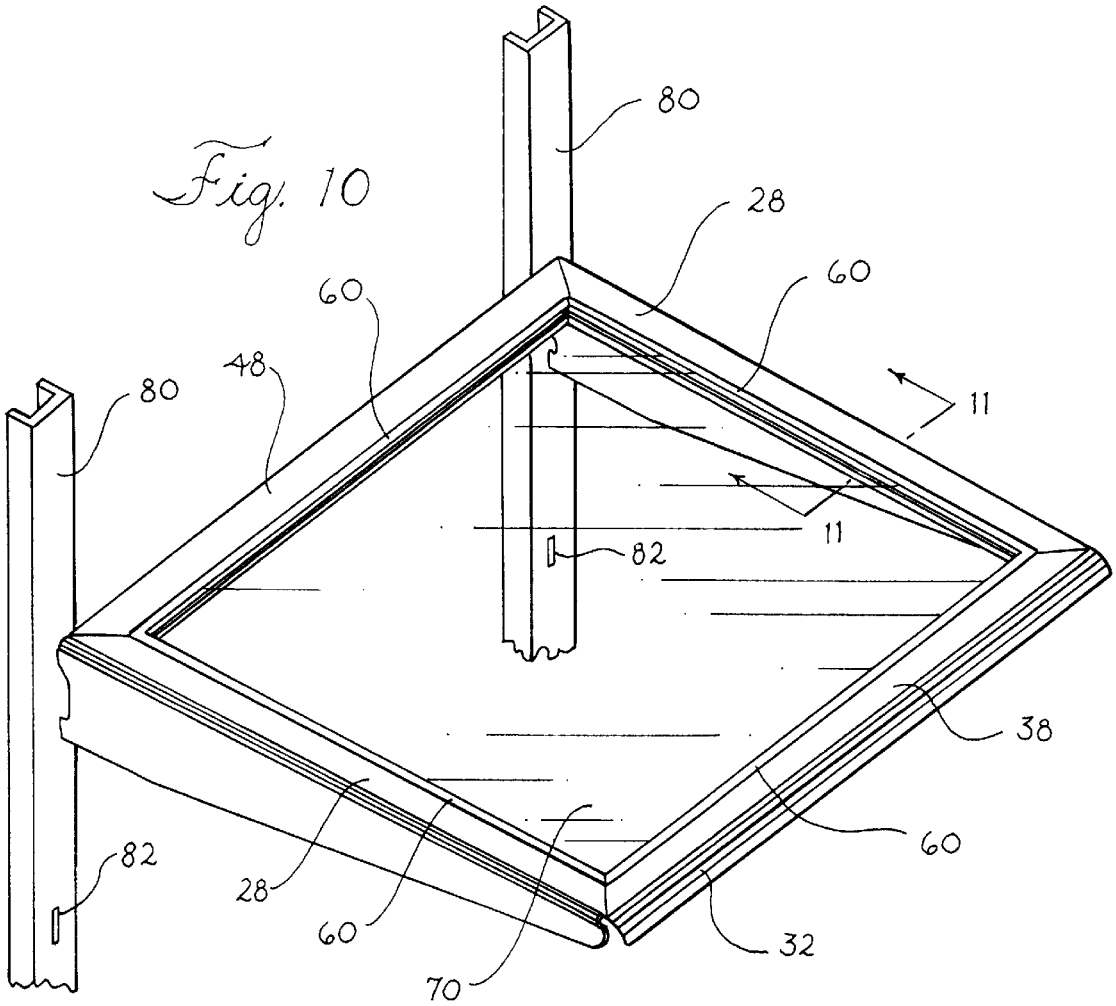
FIG. 10 is a perspective view of the refrigerator shelf secured to a pair of shelf ladder brackets.
Figure 11:
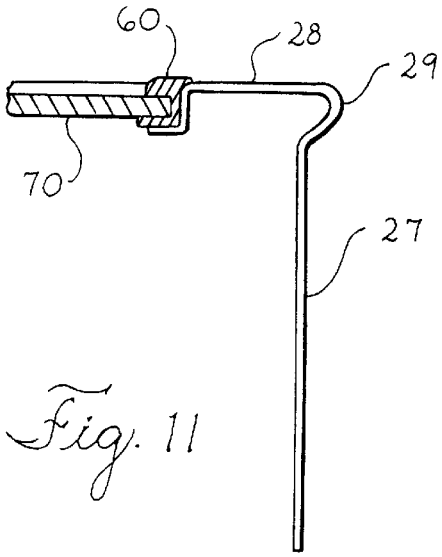
FIG. 11 is a cross section view taken along lines 11—11 of FIG. 10.

The left 22 and right 23 frame brackets are mirror images of each other. Each frame bracket 22, 23 includes a pair of hooks 26 that protrude from the rear edges of vertical sides 27. The hooks 26 function to adjustably mount the refrigerator shelf 10 on shelf ladder brackets 80 that are secured to the refrigerator frame and located at the rear wall of the refrigerator cabinet (see FIG. 10). As is conventional, the shelf ladder brackets 80 have a plurality of slots 82 formed therein which receive the hooks 26 and permit the refrigerator shelf 10 to be mounted in the refrigerator cabinet at selected elevations. This enables the unitary shelf storage system to be placed at any selected vertical position within the compartment. The vertical sides 27 of the unitary shelf storage system each include hooks 26 at the rear that mate with slots 82 formed in the shelf ladder brackets 80 to retain the shelf. Sufficient clearance is provided between the vertical sides 27 and the channel to allow the shelf to be moved by slightly lifting the front of the shelf to relieve the pressure between the top hook and the channel, and then applying a lateral force to remove the hooks 26 from the slots 82. A hook 26 at the bottom of each vertical side 27 extends into a slot 82 formed in the brackets 80. The pair of hooks 26 prevents the shelf from becoming accidentally dislodged when, for example, the front of the shelf is lifted. To intentionally dislodge the shelf, the front of the shelf must be lifted until the bottom hooks of the vertical sides 27 are pivoted out of the channel, then tipping the shelf, causing the top hooks to pivot out of the slots 82. The left and right frame brackets 22, 23 function as cantilevered beams extending forward from the shelf ladder brackets 80. The vertical sides 27 of frame brackets 22, 23, as best seen in FIGS. 2 and 5, have a greater height at the rear where stress is maximum than at the front. It should be noted that FIG. 5 is a cross section view taken along lines 5—5 of FIG. 2. The cross section configuration of frame brackets 22, 23 provides the refrigerator shelf 10 with sufficient strength to be secured solely at its rear edge to the shelf brackets 80 and extend forward therefrom in cantilevered fashion. As best seen in FIG. 11, which is similar to FIG. 5 but includes the seal 60 and the tempered glass shelf 70, the frame brackets 22, 23 include flat upper surfaces 28 that are integrally connected to the vertical sides 27 by beaded edges 29 that have a half tube cross section. The beaded edges 29, as best seen in FIGS. 5, 5A and 11, provide the frame brackets 22, 23 with a T-beam cross section which contributes to the rigidity and strength of vertical sides 27. The inwardly facing edges of flat upper surfaces 28 include shelf sections 30 extending therealong at a level below the flat upper surfaces 28.

The shelf sections 30 will, subsequently, be discussed in greater detail. The ends of the flat upper surfaces 28 are cut along diagonals 31 (see FIG. 8) which abut against and are joined to diagonal edges 41 of the front 24 and rear 25 frame sections.

Figure 6:
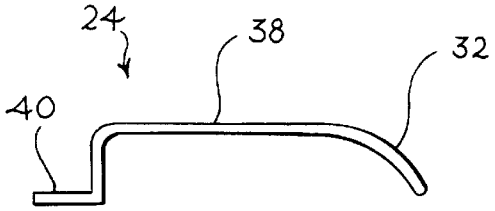
FIG. 6 is a cross section view of the front of the frame taken along lines 6—6 of FIG. 3.
Figure 8:
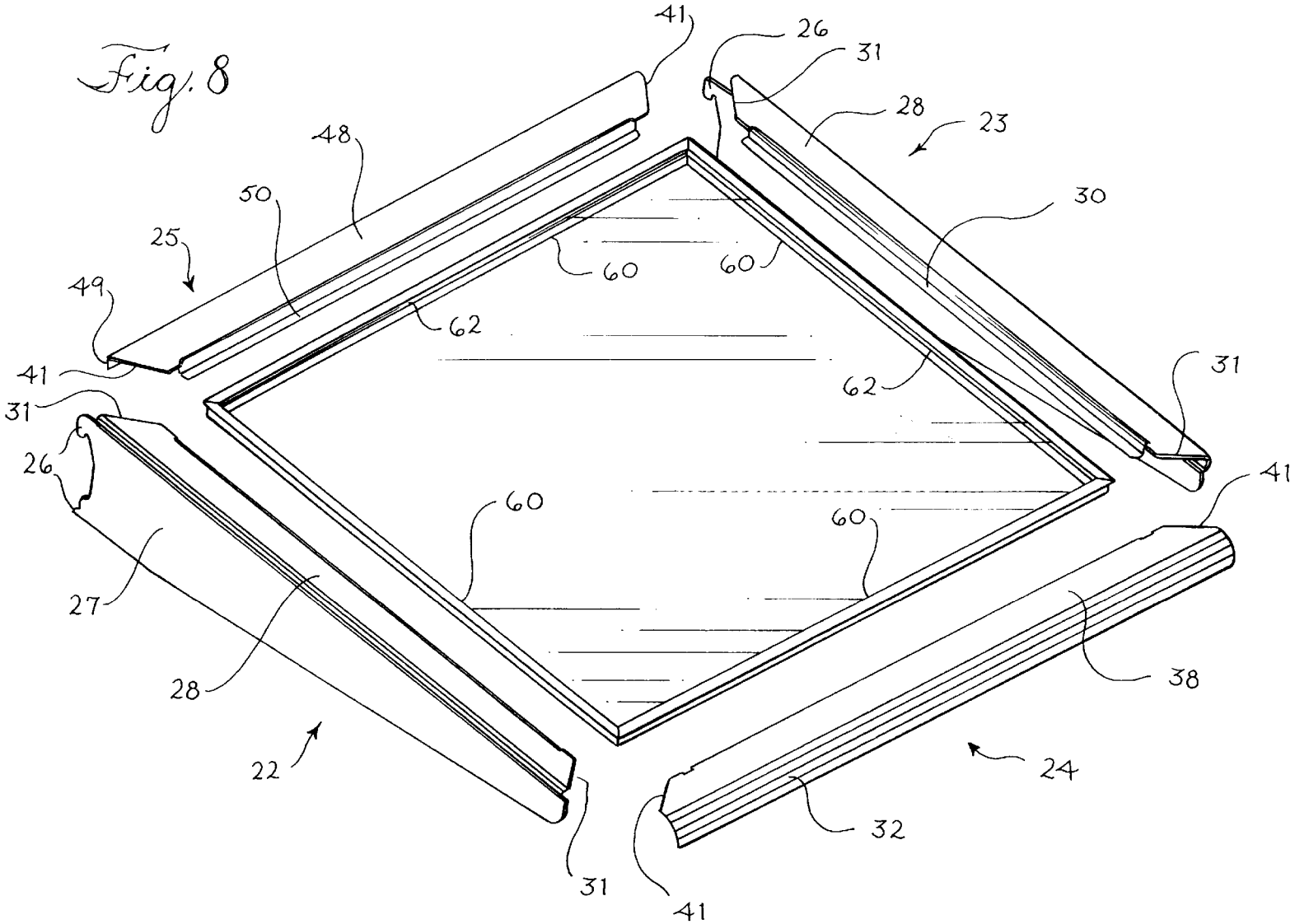
FIG. 8 is an exploded view of the refrigerator shelf.

As best seen in FIG. 6 and 8, the front frame section 24 has a flat upper surface 38 that terminates in diagonal edges 41. The flat upper surface 38, in the assembled refrigerator shelf 10, lies in the same plane as the flat upper surfaces 28 of the left 22 and right 23 frame brackets. The diagonal edges 41 of front frame section 24 abut with and are joined by welding to the diagonal edges 31 of frame brackets 22 and 23. There is a downwardly directed front edge 32 having an arcuate cross section extending from the front edge of flat upper surface 38. The surface of front edge 32 is formed of a plurality of small, horizontally extending tubular surfaces which provide a gripping surface for the refrigerator shelf 10 that is useful in installing and removing the shelf. The inwardly facing edges of flat upper surfaces 38 have a shelf section 40 extending therealong at a level below the flat upper surface 38. The shelf section 40 will, subsequently, be discussed in greater detail.

Figure 7:
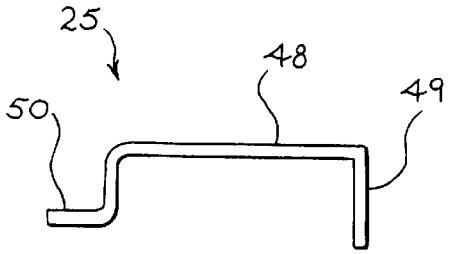
FIG. 7 is a cross section view of the back of the frame taken along lines 7—7 of FIG. 4.

As best seen in FIGS. 7 and 8, the back frame section 25 has a flat upper surface 48 that terminates in diagonal edges 41. The flat upper surface 48, in the assembled refrigerator shelf 10, lies in the same plane as the flat upper surfaces 28 of the left 22 and right 23 frame brackets. The diagonal edges 41 of rear frame section 25 abut with and are joined by welding to the diagonal edges 31 of frame brackets 22 and 23. There is a downwardly extending rear edge 49 that is normal to the flat upper surface 48. The inwardly facing edge of flat upper surface 48 has a shelf section 50 extending therealong at a level below the flat upper surface 48. The shelf sections 50 will, subsequently, be discussed in greater detail.

The diagonal edges 31 and 41 are welded from the bottom surfaces of flat upper surfaces 28, 38 and 48. By welding from the bottom surfaces, the bead of weld that is produced on the top surface is minimal. The weld bead along upper surfaces 28, 38 and 48 are then removed by a scarfing blade or a grinding process such that, when the frame is finished, the welds are not visible and the frame appears to be formed of a single piece of material. Grinding, which is the most accurate of all machine processes, is called "surface grinding" when metal is removed from a flat surface. It is contemplated that, in production of this invention, the grinding tool will be made of BORAZON which is a boron nitride of cubical crystallization that is as hard as diamond but is more resistant to high temperatures. The completed frame, which has a shape that cannot be produced from a single sheet of material as a stamping, has been produced from four individual stampings and assembled as a weldment. The completed frame has the appearance of having been produced from a single piece of material. Welding the individual stampings together is a very important step in producing this quality product. The welding process used to connect the frame parts together must produce a clean weld that is very strong and can support the relatively large weight that is often placed on a refrigerator shelf. If, for example, rust forms on the weld seam during the welding process then, in a relatively short time span, the rust will emerge through the finish coat that has been placed on the refrigerator shelf. This rust will not only weaken the product but also adversely affect the appearance of the refrigerator shelf. A laser welding system is preferred for joining diagonal edges 31 and 41. However, MIG or TIG welding systems can also be used for this purpose. Laser welding systems are very fast and the molten weld is protected from atmospheric impurities by an inert shielding gas such as Helium. Each of these welding systems produce high-quality welds at a rapid rate. When a laser welding system is used to weld a set of diagonal edges, a support is provided for supporting and positioning one of the frame sections in a horizontal reference plane. The diagonal edge of this frame section is aligned with the axis of the laser beam and this first frame section is secured in this position. The second frame section is positioned relative to the first frame section with the diagonal edges abutting. A lateral force is applied to the second frame section in a direction forcing the abutted diagonal edges to be welded into engagement. A welding unit employing a laser beam is moved along the joint line of the first and second frames.

The laser beam in a normal laser welding apparatus has a width of about 500 to 600 microns. However, if the beam is defocused, its width can be increased to about 1,000 to 1,200 microns. When the diagonal edges 31 and 41 are welded from the bottom surfaces with such a defocused laser beam, the flat top or upper surfaces 28, 38 and 48 are exposed to heat sufficient to cause some melting. For example, small burrs formed in the stamping-sheering process are melted. The diagonal edges will be filled in with the melted surface material. When this modified laser welding process is used, the welds are less visible and the frame appears to be formed of a single piece of material. As a result, the step of scarfing or grinding the upper surface along the weld joint may not be necessary.

Gas Tungsten arc welding, commonly referred to as "TIG" (tungsten inert gas), is a welding process for fusing two pieces of metal together using heat produced by an electric arc that is established between the weldment and a non-consumable Tungsten electrode. In the TIG process, the arc is stable and the molten weld metal is protected from atmospheric impurities by an inert shielding gas, usually argon or helium. This process greatly reduces the likelihood of corrosion in the welded joint.

Metal Inert Gas (MIG) welding systems utilize contact tips and gas diffusers which wear out during use and, for this reason, these components are known as consumables. In MIG welding, a metal welding wire feeds through the contact tip and provides a molten pool which is used to join the metal pieces together. The metal welding wire in a MIG system is protected from atmospheric contamination by a blanket of shield gas. The shield gas is an inert gas or a combination of inert gases plus other gases. The MIG metal welding wire is generally rolled onto a spool and is continuously fed through a coaxial welding cable to the welding gun. The contact tips and gas diffusers of MIG systems have a greater mass than corresponding prior art components which, coupled with a three point thermal and electrical engagement, increase the life of the tips over the prior art.

The assembled frame will be painted using solid-emulsion or powder coating. However, prior to painting, a zinc-chromate coating is applied to the assembled frame. The zinc-chromate coating protects the entire surface of the assembled frame against rust and, thus, provides an excellent coating to which the paint can be applied.

Zinc is more corrosion-resistant than steel and is electrically attracted to steel. Thus, an initial zinc coating is applied to the sheet steel frame assembly. A chromate conversion coating is applied over the zinc coating. The chromate conversion coating is applied by a simple immersion process and afford additional protection and retards white corrosion. The combination of the zinc and chromate conversion coating is referred to as a zinc-chromate coating. Numerous chromating solutions are available, all of which basically rely on an acidic solution of chromic acid or an aqueous solution of the dichromate having an acidity at least equivalent to 0.3 per cent sulfuric acid. The film that is formed is relatively soft until dried by exposure to air.

The chromate film has a water-absorbing characteristic while it is in the hydrated form. As a result, if the surface is scratched or damaged, water is absorbed by the film which swells and mends the damaged areas. This is called the "self healing effect."

If the unprotected chromate film is dried at temperatures in excess of 1600° F., the film becomes irreversibly dehydrated and the "self healing effect" is lost. However, if the chromate film is painted, it can withstand the high curing temperatures encountered in the painting process. The layer of paint functions to seal the water of hydration in the chromate film.

The assembled frame is painted using solid-emulsion or powder coating. In this method of painting, the paint is sprayed onto the surface in a powder form and adheres by electrostatic attraction. Heat is applied which causes the powder particles to flow and form a smooth even layer of paint.

Figure 9:
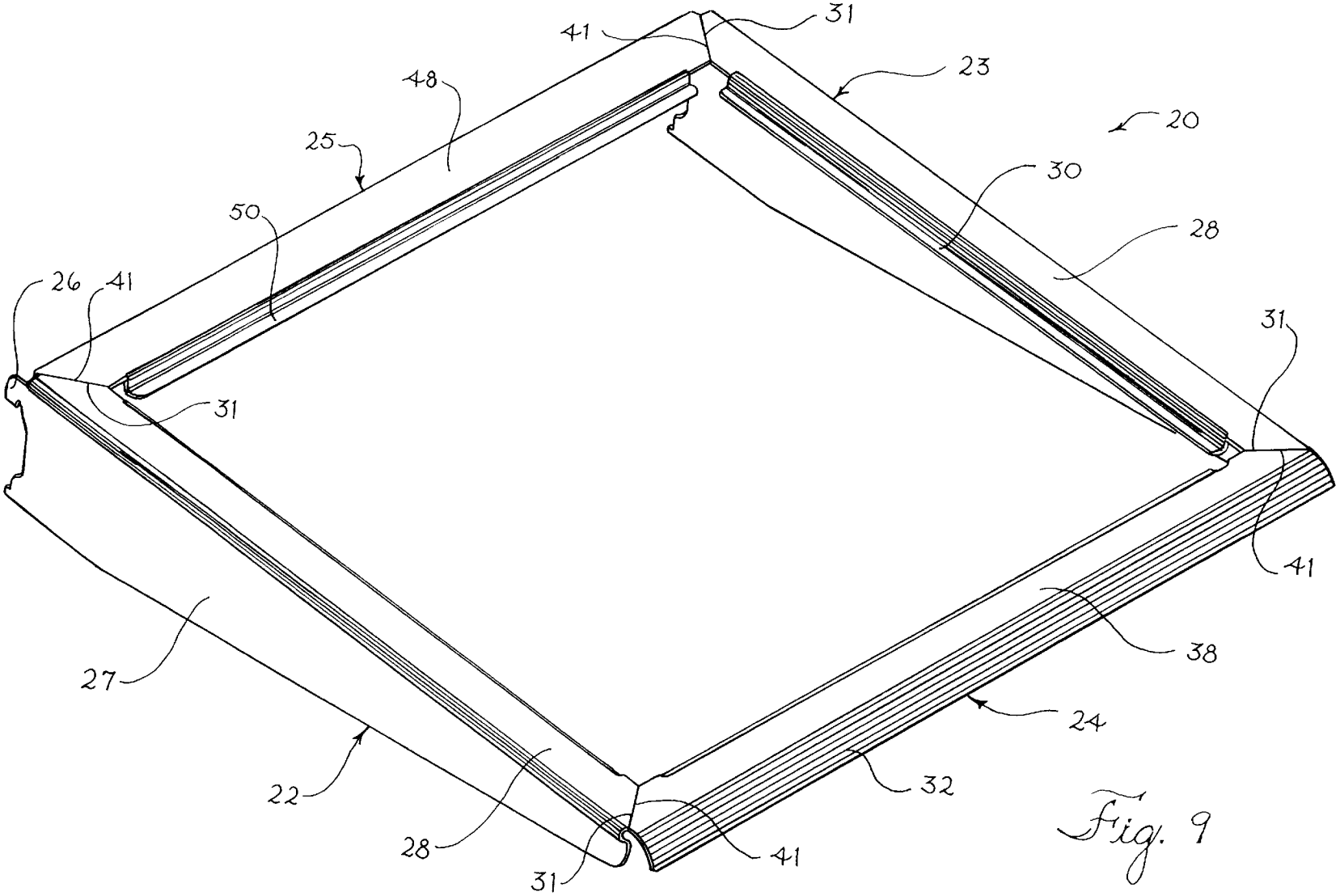
FIG. 9 is a perspective view of the frame sub assembly seen in FIG. 1.
Figure 12:
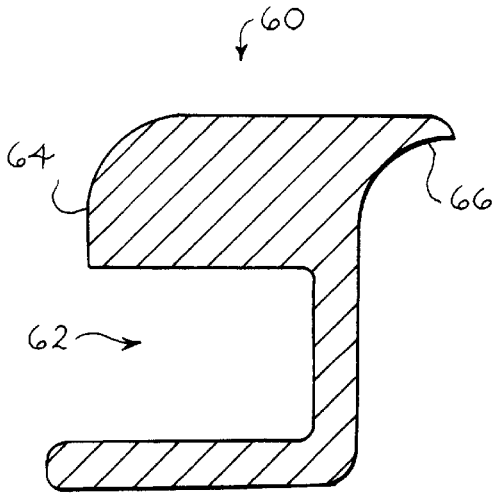
FIG. 12 is an enlarged perspective view of a section of material from which the rim is constructed.

As best seen in FIG. 9, the shelf sections 30, 40 and 50 all lie in the same horizontal plane. A square or rectangular shaped glass shelf 70 having a seal 60 secured to its entire peripheral edge is supported on the shelf sections 30, 40 and 50 (see FIG. 8). A cross section of the seal 60 is illustrated in FIG. 12. The seal 60 includes a groove 62 that receives the peripheral edge of the glass shelf 70. The groove 62 is dimensioned to snugly grip the surfaces of the glass shelf 70 to thus form a seal that will prevent liquid, such as water, to pass from the surface of the glass shelf 70 through the seal. The seal 60 includes a vertical wall 64 that extends upwardly from the upper surface of glass shelf 70 and functions as a dam to retain water or other liquid that has been spilled on the shelf. The height of the vertical wall 64 and the surface area of the glass shelf 70 are sufficient that a twelve-ounce container of liquid can be spilled on a shelf and will be contained within the confines formed by the top surface of the glass shelf 70 and the vertical walls 64 of the seal 60. A lip 66 is provided on the upper outer edge of the seal 60 that laps over the flat upper surfaces 28, 38 and 48. The seal 60 is formed of flexible and resilient plastic material.

Figure 13:
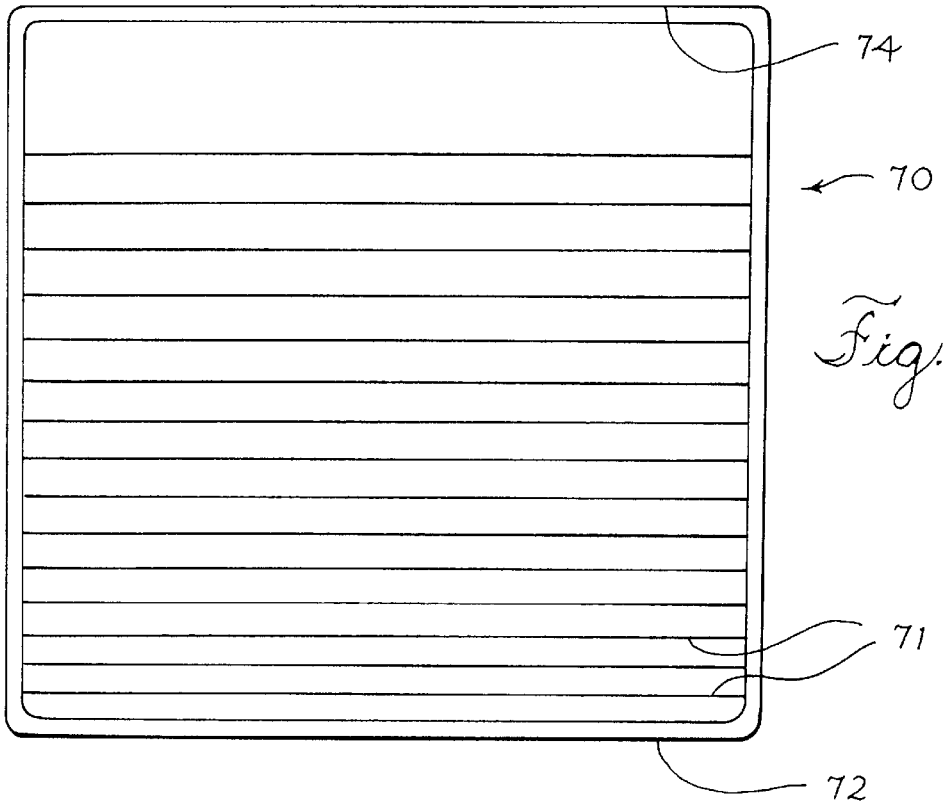
FIG. 13 is a top view of the shelf with the seal molded to the glass shelf.

The seal 60, of the embodiment illustrated in FIG. 13, is formed by an injection molding process in which the injection molding forms overlap the peripheral edges of the glass shelf 70 and the entire seal 60 is molded as an integral piece. It should be noted that, as shown in FIG. 13, the corners of the seal are rounded and the seal has no visible joints. This embodiment has the advantage that the seal is bonded to the glass shelf and the shelf has greater aesthetic appeal. Although molding processes are time-consuming, this process can be performed at an acceptable rate by having two stations at which the forms are loaded to the glass shelf 70. As a seal for a first shelf is being molded to a glass shelf 70, the forms for a second shelf are being assembled to the glass shelf 70 at a loading station. When the molding process is completed, the completed product is indexed away for removal from the mold as the other assemble form is indexed into place in the molding machine. The very small volume of material contained in the seal 60 requires a short injection period as well as a short cure period. The glass shelf 70 shown in this Figure includes a series of parallel lines that are indicia 71 that function to make the shelf surface more visible to the consumer. It should be noted that the parallel lines that form the indicia 71 are closer together at the front edge 72 of the shelf than at the rear edge 74. The front portion of the shelf is more visible to the consumer and, if the consumer is aware of the location of the front portion of the shelf, s/he will also be aware of the back portion. The indicia 71 is minimized to permit maximum visibility within the refrigeration unit. Although the indicia 71 is illustrated as a series of parallel lines, it should be understood that the indicia could be in other forms such as the manufacturer's trademark.

Figure 14:
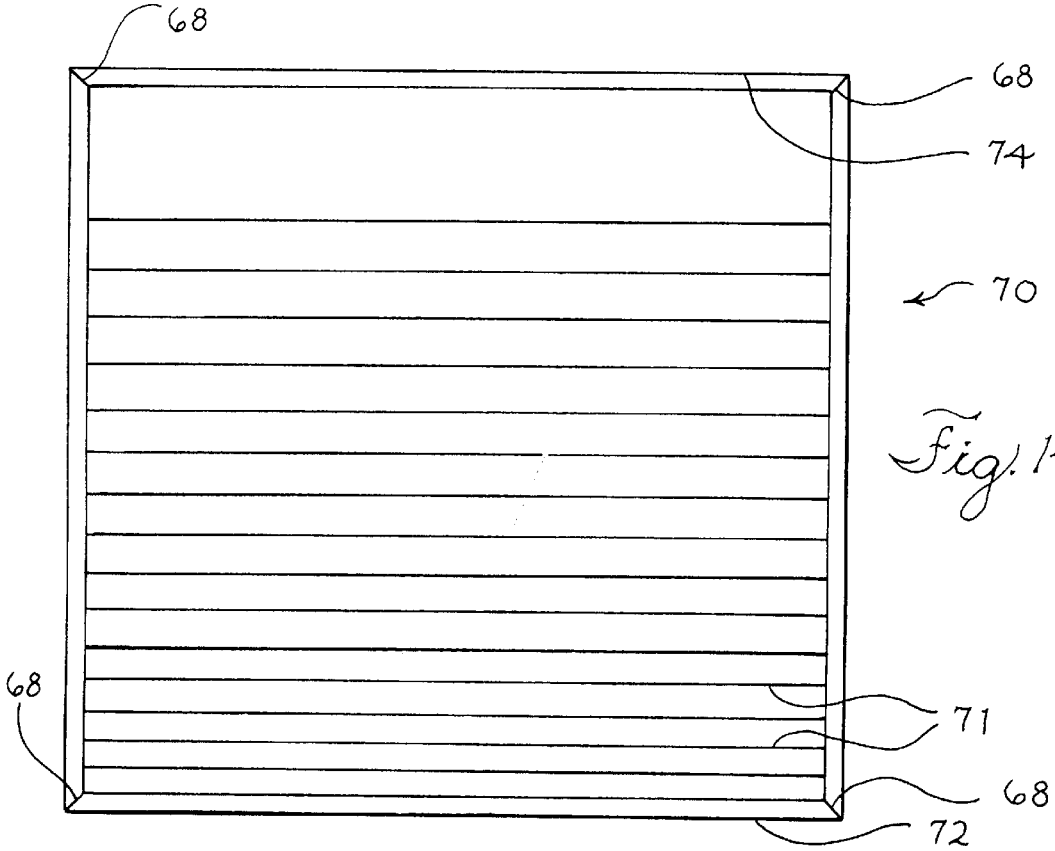
FIG. 14 is a top view of the shelf with the seal fabricated from extruded sections of seal material.

A second embodiment of the seal 60 is illustrated in FIG. 14. In this embodiment, the seal 60 is extruded in a continuous strip of material which is then cut to size along diagonal edges 68. Contact cement is applied to the diagonal edges 68 and the cut sections of seal applied to the peripheral edges of the glass shelf 70. The diagonal edges 68 that are coated with contact cement are properly located relative to each other and pressed together to form a sealed bond. A glass shelf 70, having a seal 60 formed by extrusion, is shown in FIG. 14. It should be noted that the intersecting corners of the seal 60 are square and the joint between the diagonal edges 68 are visible. The extrusion process for producing the seal material is extremely fast and the color and elasticity of the seal material can be precisely controlled. The glass shelf 70 shown in FIG. 14 also includes a series of parallel lines that represent indicia 71.

The glass shelf 70 with the seal 60 of either embodiment attached is pressed into the retainer formed by the shelf sections 30, 40 and 50.

Another embodiment of the shelf section is shown in FIG. 5A. In this embodiment, the vertical wall 35 is at 89 degrees from the horizontal to thus produce a shelf having an undercut that functions as a retainer. The seal expands into this undercut and functions to lock the glass shelf 70 to the frame 20.

The glass shelf 70 with the seal 60, of either of the above discussed embodiment, attached is pressed into the retainer formed by the shelf sections 30, 40 and 50.

Figure 15:
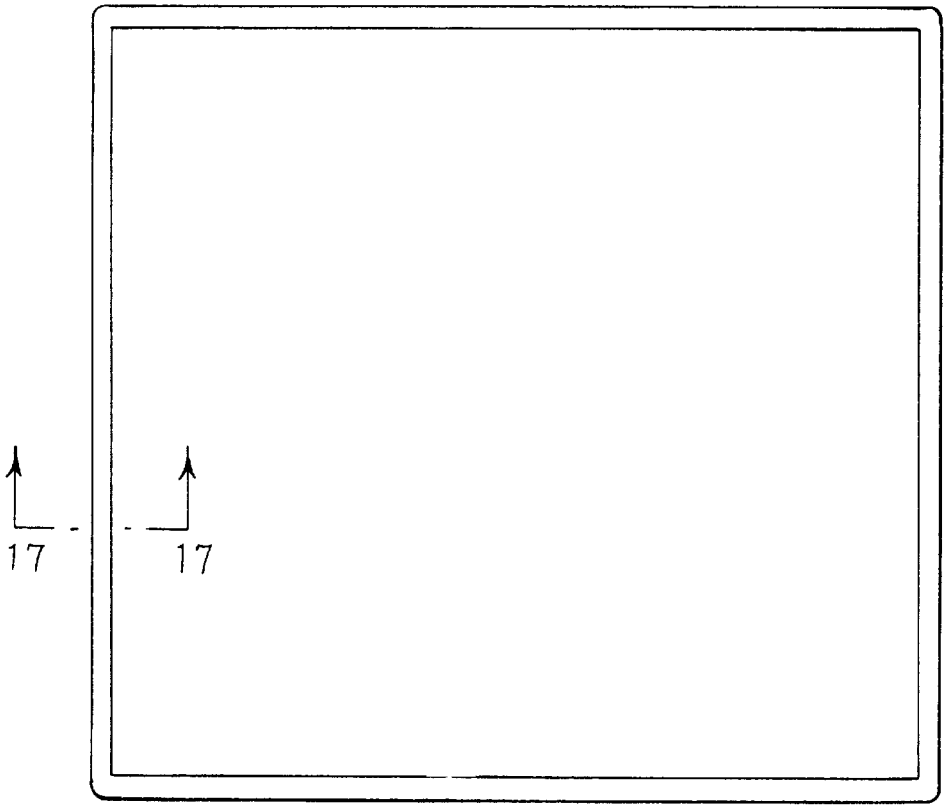
FIG. 15 is a top view of another embodiment of a molded seal.
Figure 16:
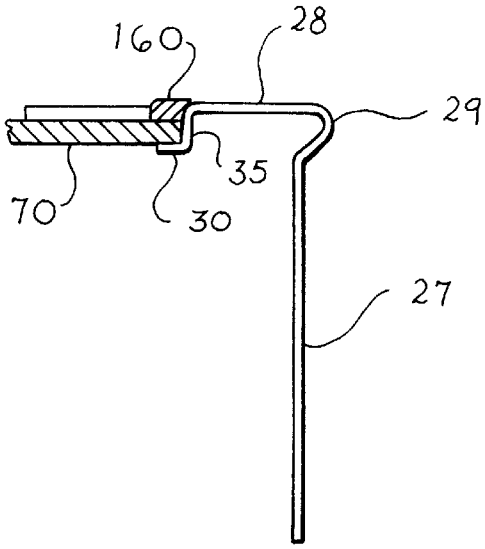
FIG. 16 is a cross section view similar to FIG. 11 but including the seal illustrated in FIG. 15.
Figure 17:
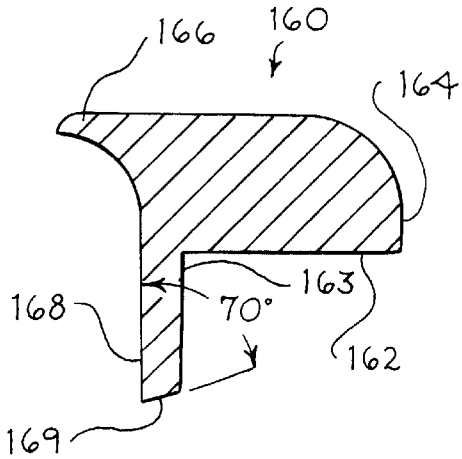
FIG. 17 is an enlarged cross section view of the seal taken along lines 17—17 of FIG. 15.

A third embodiment of the seal 160 is illustrated in FIGS. 15–17. In this embodiment, the seal 160 is molded in a single piece seal that is shaped to conform with the peripheral edge of the glass shelf. In this embodiment, the corners can be rounded and, thus, contribute to the aesthetic appeal of the shelf. As best seen in FIG. 17, which is a cross section of seal 160 taken along lines 17—17 of FIG. 15, the seal 160 includes surfaces 162 and 163 that engage the upper surface and edge of the glass shelf 70, respectively, to form a seal that will prevent liquid such as water to pass from the surface of the glass shelf 70 through the seal. The seal 160 includes a vertical wall 164 that extends upwardly from the upper surface of glass shelf 70 and functions as a dam to retain water or other liquid that has been spilled on the shelf. The height of the vertical wall 164 and the surface area of the glass shelf 70 are sufficient that a twelve-ounce container of liquid can be spilled on a shelf and will be contained within the confines formed by the top surface of the glass shelf 70 and the vertical walls 164 of the seal 160. A lip 166 is provided on the upper outer edge of the seal 160 that laps over the flat upper surfaces 28, 38 and 48. The seal 160 includes a downwardly extending flange 168 has a bottom edge 169 that is at an angle of about 70 degrees to the vertical. The seal 160 is formed of flexible and resilient plastic material.

FIG. 16 is a cross section view of an edge of the shelf utilizing the seal 160. It should be noted that, in this embodiment, the glass 70 rests directly on the shelf section 30 rather than on a portion of the seal as in the other embodiments of the seal. As a consequence, a shelf utilizing this embodiment of the seal will be easier to assemble. The glass shelf 70 can be placed on the shelf section 30 and the seal 160 located around the peripheral edges of the glass shelf and the downwardly extending flange 168 having a bottom edge 169 that is at an angle of about 70 degrees to the vertical is forced down between the edge of the glass shelf 70 and the vertical wall 35 of the shelf. The bottom edge 169 of the flange 168 facilitates maneuvering the flange 168 into its proper location between the edge of the glass shelf 70 and the vertical wall 35 of the shelf. Another assembly method is to attach the seal 160 to the peripheral edges of the glass shelf 70 and then force the shelf 70, with the attached seal 160, into the shelf section 30. For both methods of assembly, a glue or adhesive can be applied to secure the seal 160 and glass shelf 70 in the position seen in FIG. 16.

The assembled frame is coated with a zinc chromate film and then painted using a solid-emulsion or powder coating process. In this process, after the zinc-chromate film has been applied to the frame assembly, the paint is sprayed onto the surface in a powder form and adheres by electrostatic attraction. Heat is applied which causes the powder particles to flow and form a smooth even layer of paint.

It should be understood that the foregoing disclosure is illustrative of the broad inventive concepts comprehended by this invention and that various other modifications and improvements may be made to the invention without departing from the spirit of the disclosed concept.

What is claimed is:

1. The method of producing a shelf for a refrigerator or freezer comprising the steps of:

a. forming components of a shelf frame by stamping the components from sheet metal such that a plurality of components include a section that when assembled will form a shelf section including a flat horizontal portion and undercuts, said shelf section being accessible from above;

b. assembling the shelf frame components by welding;

c. applying a zinc-chromate coating to the assembled shelf frame;

d. painting the assembled shelf frame;

e. forming an elongated flexible seal by an extrusion process;

f. providing a tempered glass shelf that is dimensioned to be received on a shelf section of the shelf frame;

g. cutting sections of the flexible seal to dimensions such that when the sections of the flexible seal are applied to the peripheral edge of the tempered glass shelf, the entire peripheral edge will be covered by the seal;

h. applying the sections of flexible seal to the peripheral edge of the tempered glass shelf;

i. attaching the free ends of the sections of flexible seal such that a continuous seal extends around the entire peripheral edge of the tempered glass shelf; and j. inserting the tempered glass shelf with the flexible seal applied to its peripheral edge by moving the glass shelf vertically into the shelf section of the shelf frame from above the shelf frame such that said flexible seal is compressed and then expands into said undercuts to lock said tempered glass shelf in place.

2. The method of producing a shelf for a refrigerator or freezer comprising the steps set forth in claim 1 wherein the welding step is performed on the bottom surface of the shelf frame.

3. The method of producing a shelf for a refrigerator or freezer comprising the steps set forth in claim 2 wherein the weld bead on the upper surface of the shelf frame is removed by using a scarfing blade.

4. The method of producing a shelf for a refrigerator or freezer comprising the steps set forth in claim 2 wherein the weld bead on the upper surface of the shelf frame is removed by a grinding process.

5. The method of producing a shelf for a refrigerator or freezer comprising the steps set forth in claim 4 wherein the grinding process is performed using a tool made of baron nitrite of cubical crystallization.

6. The method of producing a shelf for a refrigerator or freezer comprising the steps set forth in claim 2 and wherein a laser welding system is used to perform the welding step in which the laser beam has been defocused such that its width has been substantially increased which functions to smooth the weld joint on the top surface of the shelf frame.

7. The method of producing a shelf for a refrigerator or freezer comprising the steps set forth in claim 1 wherein a laser welding system is used to perform the welding step.

8. The method of producing a shelf for a refrigerator or freezer comprising the steps set forth in claim 1 wherein a MIG welding system is used to perform the welding step.

9. The method of producing a shelf for a refrigerator or freezer comprising the steps set forth in claim 1 wherein a TIG welding system is used to perform the welding step.

10. The method of producing a shelf for a refrigerator or freezer comprising the steps set forth in claim 1 wherein the step of painting the shelf frame is performed by using a solid-emulsion process.

11. The method of producing a shelf for a refrigerator or freezer comprising the steps set forth in claim 1 wherein the step of painting the shelf frame is performed by using a powder coating process.

12. A refrigerator or freezer shelf formed by the method set forth in claim 1.

13. The refrigerator shelf as set forth in claim 12 wherein the invention further comprises:

said flexible seal includes a vertical wall that extends upwardly from the tempered glass and functions as a dam to retain spilled liquids on the tempered glass.

14. The method of producing a shelf for a refrigerator or freezer, comprising the steps of:

a. forming components of a shelf frame by stamping the components from sheet metal such that a plurality of components include a section that when assembled will form a shelf section including a flat horizontal portion having side walls that are substantially vertical and include undercuts said shelf section being accessible from above;

b. assembling the shelf frame components by welding;

c. applying a zinc-chromate coating to the assembled shelf frame;

d. painting the assembled shelf frame;

e. providing a tempered glass shelf having a peripheral edge;

f forming a one piece flexible seal by a molding process;

g. applying and bonding said one piece flexible seal to the peripheral edge of said tempered glass shelf;

h. inserting the tempered glass shelf with the molded flexible seal bonded to its peripheral edge with a vertical movement, from above the shelf, into the shelf section of the shelf frame such that said flexible seal is compressed and then expands into said undercuts formed in said substantially vertical side walls to lock the tempered glass shelf in place.

15. The method of producing a shelf for a refrigerator or freezer comprising the steps set forth in claim 14 wherein the welding step is performed on the bottom surface of the shelf frame.

16. The method of producing a shelf for a refrigerator or freezer comprising the steps set forth in claim 15 wherein the weld bead on the upper surface of the shelf frame is removed by using a scarfing blade.

17. The method of producing a shelf for a refrigerator or freezer comprising the steps set forth in claim 15 wherein the weld bead on the upper surface of the shelf frame is removed by a grinding process.

18. The method of producing a shelf for a refrigerator or freezer comprising the steps set forth in claim 17 wherein the grinding process is performed using a tool made of baron nitrite of cubical crystallization.

19. The method of producing a shelf for a refrigerator or freezer comprising the steps set forth in claim 15 and wherein a laser welding system is used to perform the welding step in which the laser beam has been defocused such that its width has been substantially increased which functions to smooth the weld joint on the top surface of the shelf frame.

20. The method of producing a shelf for a refrigerator or freezer comprising the steps set forth in claim 14 wherein a laser welding system is used to perform the welding step.

21. The method of producing a shelf for a refrigerator or freezer comprising the steps set forth in claim 14 wherein a MIG welding system is used to perform the welding step.

22. The method of producing a shelf for a refrigerator or freezer comprising the steps set forth in claim 14 wherein a TIG welding system is used to perform the welding step.

23. The method of producing a shelf for a refrigerator or freezer comprising the steps set forth in claim 14 wherein the step of painting the shelf frame is performed by using a solid-emulsion process.

24. The method of producing a shelf for a refrigerator or freezer comprising the steps set forth in claim 14 wherein the step of painting the shelf frame is performed by using a powder coating process.

25. A refrigerator or freezer shelf formed by the method set forth in claim 14.

26. The refrigerator shelf as set forth in claim 25 wherein the invention further comprises:

said flexible seal includes a vertical wall that extends upwardly from the tempered glass and functions as a dam to retain spilled liquids on the tempered glass.

27. The method of producing a shelf for a refrigerator or freezer comprising the steps of:

a. forming components of a shelf frame by stamping the components from sheet metal such that a plurality of components include a section that when assembled will form a shelf section including a flat horizontal portion having side walls that are substantially vertical and includes undercuts, said shelf section being accessible from above;

b. assembling the shelf frame components by welding;

c. painting the assembled shelf frame;

d. forming a continuous flexible seal by an extrusion process;

e. providing a tempered glass shelf that is dimensioned to be received on a shelf section of the shelf frame;

f. cutting sections of the flexible seal to dimensions such that when the sections of the flexible seal are applied to the peripheral edge of the tempered glass shelf the entire peripheral edge will be covered by the seal;

g. applying the sections of flexible seal to the peripheral edge of the tempered glass shelf;

h. attaching the free ends of the sections of flexible seal such that a continuous seal extends around the entire peripheral edge of the tempered glass shelf; and i. inserting the tempered glass shelf with the flexible seal applied to its peripheral edge with a vertical movement, from above the shelf, into the shelf section of the shelf frame such that said flexible seal is compressed and then expands into said undercuts formed in said substantially vertical side walls to lock the tempered glass shelf in place.

28. The method of producing a shelf for a refrigerator or freezer comprising the steps set forth in claim 27 wherein the welding step is performed on the bottom surface of the shelf frame.

29. The method of producing a shelf for a refrigerator or freezer comprising the steps set forth in claim 28 wherein the weld bead on the upper surface of the shelf frame is removed by using a scarfing blade.

30. The method of producing a shelf for a refrigerator or freezer comprising the steps set forth in claim 28 wherein the weld bead on the upper surface of the shelf frame is removed by a grinding process.

31. The method of producing a shelf for a refrigerator or freezer comprising the steps set forth in claim 30 wherein the grinding process is performed using a tool made of baron nitrite of cubical crystallization.

32. The method of producing a shelf for a refrigerator or freezer comprising the steps set forth in claim 28 and wherein a laser welding system is used to perform the welding step in which the laser beam has been defocused such that its width has been substantially increased which functions to smooth the weld joint on the top surface of the shelf frame.

33. The method of producing a shelf for a refrigerator or freezer comprising the steps set forth in claim 27 wherein a laser welding system is used to perform the welding step.

34. The method of producing a shelf for a refrigerator or freezer comprising the steps set forth in claim 27 wherein a MIG welding system is used to perform the welding step.

35. The method of producing a shelf for a refrigerator or freezer comprising the steps set forth in claim 27 wherein a TIG welding system is used to perform the welding step.

36. The method of producing a shelf for a refrigerator or freezer comprising the steps set forth in claim 27 wherein the step of painting the shelf frame is performed by using a solid-emulsion process.

37. The method of producing a shelf for a refrigerator or freezer comprising the steps set forth in claim 27 wherein the step of painting the shelf frame is performed by using a powder coating process.

38. A refrigerator or freezer shelf formed by the method set forth in claim 27.

39. The refrigerator shelf as set forth in claim 38 wherein the invention further comprises:

said flexible seal includes a vertical wall that extends upwardly from the tempered glass and functions as a dam to retain spilled liquids on the tempered glass.

* * * * *